United States Patent [19]

Baraldi et al.

[11] 4,060,042

[45] Nov. 29, 1977

[54] INCINERATOR

[75] Inventors: Enzo Baraldi; Giuliano Longhi, both of Bologna, Italy

[73] Assignee: Fire Victor Holding S.A., Luxembourg, Luxembourg

[21] Appl. No.: 685,911

[22] Filed: May 12, 1976

[30] Foreign Application Priority Data

May 17, 1975 Italy ..... 6488/75

[51] Int. Cl.[2] ..... F23G 5/06

[52] U.S. Cl. ..... 110/14; 110/8 A; 110/15; 432/110

[58] Field of Search ..... 110/8 R, 8 A, 14, 15; 432/105, 108, 110

[56] References Cited

U.S. PATENT DOCUMENTS

| | | | |
|---|---|---|---|
| 2,082,870 | 6/1937 | Caffrey | 110/14 |
| 2,963,996 | 12/1960 | Uhl et al. | 110/14 |
| 3,882,800 | 5/1975 | du Chambon | 110/14 |

*Primary Examiner*—Kenneth W. Sprague

*Attorney, Agent, or Firm*—McNenny, Pearne, Gordon, Gail, Dickinson & Schiller

[57] ABSTRACT

This invention relates to incinerators for the disposal of urban waste. More particularly, it relates to incinerators of the type comprising a rotary furnace of highly heat-resistant steel, having a horizontal axis of rotation and comprising a drying chamber and an incinerating chamber; drive means for rotating the furnace; charging means for feeding refuse to the drying chamber; a burner projecting into the drying chamber; afterburner means for recombusting any incompletely burned refuse leaving the incinerating chamber and for ridding combustion gases of solids; means for supplying preheated comburent air to the furnace; and means for cooling and exhausting the combustion gases.

16 Claims, 8 Drawing Figures

INCINERATOR

BACKGROUND OF THE INVENTION

Incinerators of this kind already existing utilize a rotary furnace coated internally with refractory material. One drawback of these furnaces is that the refractory coating is subject to damage caused by hard objects and explosive material such as metal and spray cans. It follows that they require frequent repairs by highly-qualified personnel, which repairs are time-consuming and consequently very costly.

A further drawback of these rotary furnaces is their considerable weight and very large size, both factors which make it impossible to install these incinerators on motor vehicles of reasonable proportions. Furthermore, rotary furnaces coated with refractory material are subject to a high degree of thermal inertia. Consequently, it takes a long time for them to reach their operating temperature and an equally long time to cool off, with the result that any repair necessitates excessively long stoppages.

Still other existing incinerators make use of rotary furnaces which have no refractory coating. These do have a lower weight and smaller size, as well as less thermal inertia, than furnaces coated with refractory material; however, they suffer from high wear since the interior walls are directly in contact with the burning waste. It follows that their useful life is relatively short. Furthermore, these furnaces are mostly of a tubular shape and must be very long since the waste must move at the same slow speed both in dessication stage and in the actual incineration stage. They cannot burn liquid wastes since these would leak out.

It is an object of this invention to provide an incinerator having a lightweight rotary furnace small enough so that the incincerator can be mounted on a normal tuck.

A further object of this invention is to provide an incinerator having a rotary furnace whose outer walls are forcibly cooled, which consequently has a longer life-span, and in which it is possible to burn liquid waste as well without having it leak out.

It is still another object of this invention to provide an incinerator having an easily manufactured rotary furnace which can be installed and removed as well as replaced directly on site by non-specialized personnel since, because of its low thermal inertia, long stoppages are avoided.

Yet another object of this invention relates to the provision of an incinerator discharging only such combustion gases as are vertually free of solids, completely burned and sterile and thus do not pollute the environment, thus enabling operation of the incinerator in residential areas, for example as a mobile unit which collects refuse directly from homes and disposes of it right on the spot.

These objects can be achieved, according to this invention, in that the furnace further comprises first and second cylindrical sections connected by a hollow, frustoconical connecting piece which is shorter than both the first and second sections, the first section containing the drying chamber and the second section containing the incinerating chamber, the first section being shorter in length and larger in diameter than the second section so that the drying chamber is shorter in length and has a larger inside diameter than the incinerating chamber and has a laterally closed-off portion; a refuse entry gate disposed at the end of the first section remote from the section and having an inside diameter smaller than that of the first section, the laterally closed-off portion of the drying chamber being situated below the level of the entry gate and the incinerating chamber for preventing liquid refuse from flowing out of the drying chamber; a slag and cinder outlet opening disposed at the end of the second section remote from the first section; a screw conveyor disposed on that portion of the inside wall of the drying chamber nearest the entry gate; a first series of conveyor blades disposed on the remainder of said inside wall of said drying chamber; a second series of conveyor blades disposed on the inside wall of the connecting piece; a third series of conveyor blades disposed on the inside wall of the incinerating chamber from the junction thereof with the connecting piece to the vicinity of the outlet opening; and a fourth series of conveyor blades disposed immediately adjacent to the outlet opening, the blades of the first series having an angle of pitch, relative to the axis of rotation, which is greater than that of the third series but less than that of the second and fourth series, and the blades of the second series having an angle of pitch, relative to the axis of rotation, which is less than that of the fourth series, the refuse thereby being rapidly carried away from the region of the entry gate by the screw conveyor upon rotation of the furnace, then moved relatively slowly through the drying chamber by the first series of blades for the purpose of drying and preheating, thereafter transported relatively quickly through the connecting piece into the incinerating chamber by the second series of blades, and moved on by the third series of blades within the incinerating chamber more slowly than in the drying chamber for being incinerated until the resultant ash reaches the fourth series of blades and is rapidly removed thereby from the rotary furnace through the outlet opening; and the incinerator further comprising for cooling the outer wall of the furnace: a stationary cooling chamber in which the furnace is mounted for rotation, at least one pusher fan for supplying cooling air to the cooling chamber, adjustable air-flow control means disposed between the at least one pusher fan and the cooling chamber for adjusting the rate of flow of the cooling air through the cooling chamber, and air-flow chanelling screens disposed on each side of the upper half of the rotary furnace and spaced therefrom for directing the cooling air around the upper half of the furnace, the screens defining an elongated opening above the furnace for the escape of the cooling air from the cooling chamber.

A preferred embodiment of the invention will now be described in detail with reference to the accompanying drawings, in which.

In all the drawings each single part is always referred to by the same number.

Figure 1:
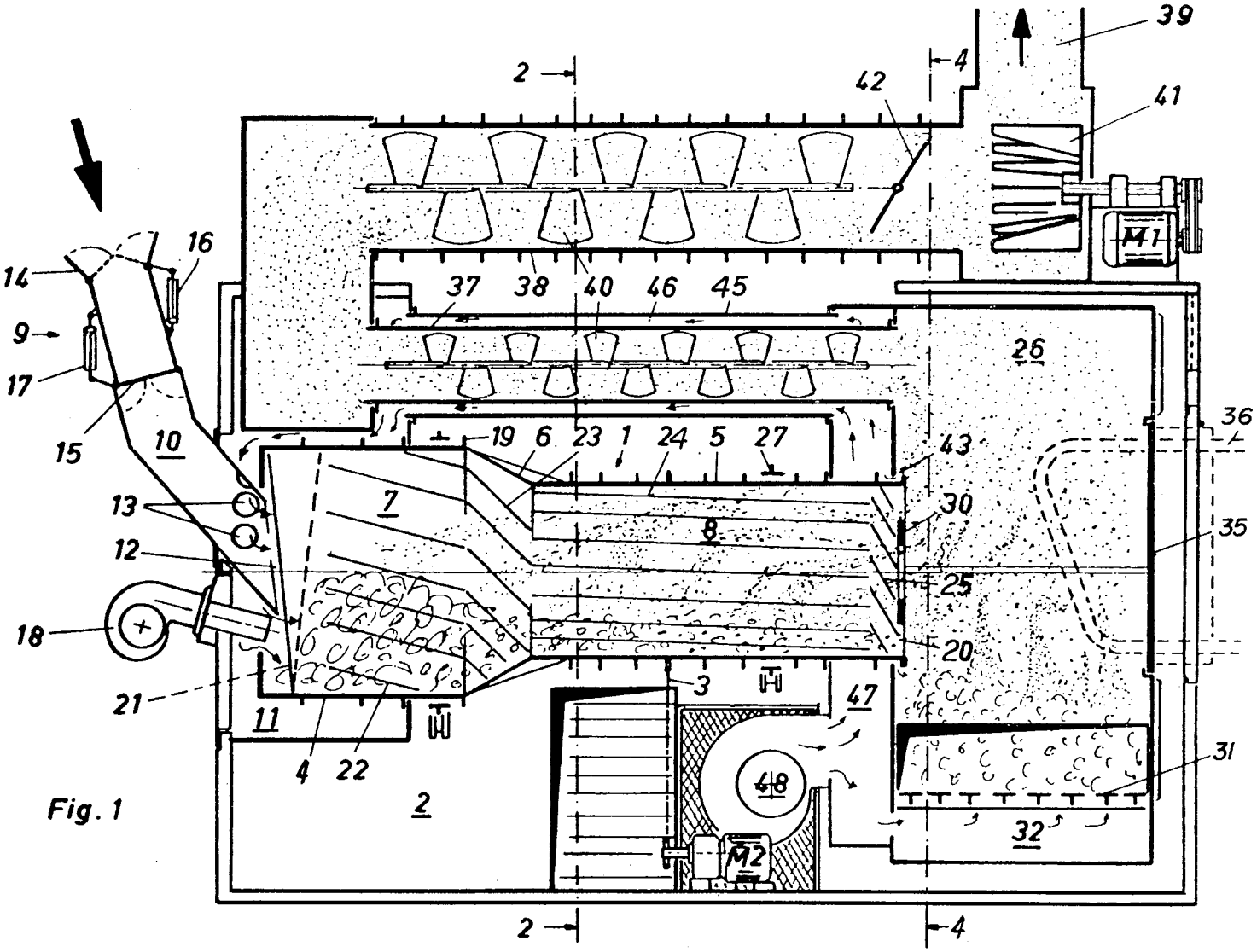
FIG. 1 is a longitudinal section through an incinerating unit according to the invention, showing the rotary furnace.

The incinerating unit illustrated in FIG. 1 comprises a rotary furnace 1 on a horizontal axis placed in a cooling chamber 2 which discharges upwards and is moved by a motor M2 through a transmission chain 3. Furnace 1 is made up of a chamber 4, *shorter* in length and larger in diameter, and of a chamber 5, *longer* in length and of lesser diameter. These two chambers 4 and 5 are connected to each other by frustoconical connecting tube 6. The inside of chamber 4 forms a drying chamber 7, and the inside of chamber 5 an incinerating chamber 8. Forced feeding or refuse or waste takes place just outside of chamber 7 through a forced-feeding device 9 which consists of a loading hopper 10 which reaches a preheating chamber 11 before reaching an entry gate 12 of chamber 4 to end in dessication chamber 7. Above chamber 11 through openings 13 at the lower end of hopper 10, preheated comburent air is blown inside of rotating oven 1, as will be explained later in more detail. The upper end of hopped 10 has upward opening flaps 14; below, there are downward opening flaps 15. These flaps are operated by two hydraulic cylinders 16 and 17 according to the temperature of the fumes exiting from the unit and are alternately opened and closed so that hopper 10 is always closed either by flaps 14 of by flaps 15.

Should one want to feed the rotating oven with combustible wastes, liquid of semi-liquid, one can avail oneself, instead of the forced-feeling device 9, of a feeding tube (not shown) which feeds directly into entry gate 12 which, in turn, is fed periodically by a dosing pump (or by another device suitable for the purpose) which would operate according to the temperature of the combustion fumes ejected by the unit.

Under the hopper 10 there is a burner 18 which, acting through preheating chamber 11, reaches entry gate 12 of furnace 1. The flame of burner 18 reaches its highest temperature in the chamber 7; this heat serves the purpose of dessicating, preheating and igniting the waste material. The outer walls of chambers 4 and 5 have cooling fins 19; the fins on the outside of chamber 4, within preheating chamber 11, transfer heat from the preheated air to the forward part of chamber 4 to accelerate the dessication of waste in drying chamber 7; the other fins on the outside of chambers 4 and 5 serve the purpose of cooling the revolving incinerator furnace, as will be explained later on.

The transport of waste from opening 12 to an afterburning chamber 26 through the cinder outlet opening 20 takes place in this manner; the inner wall of chamber 4 directly near the entry gate 12 has a screw conveyor 21 which is followed by transporting blades 22. The inner wall of the frustoconical connecting tube 6 comprises transporting blades 23, and the inner wall of chamber 6 comprises longer transporting blades 24 as well as shorter transporting blades 25.

The pitch of the transporting screw conveyor 21 and the pitch of the transporting blades 22, 23, 24, 25 are so designed that during the rotation of the revolving furnace, the transporting screw conveyor 21 moves waste through opening 12 to the inside relatively quickly to avoid the clogging of this opening. At the same time, the waste in dessication chamber 7 is moved along slowly by the transporting blades 22 with a pitch of 15 degrees toward connecting tube 6, so that the waste can reach complete dehydration, preheating and ignition in dessication chamber 7.

The waste material is then rapidly transported by the transporting blades 23 which have a pitch of 45° through connecting tube 6 into incineration chamber 8 where it is further transported by small blades 24, having a pitch from 2° to 3°, throughout the length of chamber 8, so that the waste material is substantially burned to slag and ashes by the time it reaches blades 25 having a higher pitch of 60° which rapidly unload everything into the afterburning chamber 26.

Figure 2:
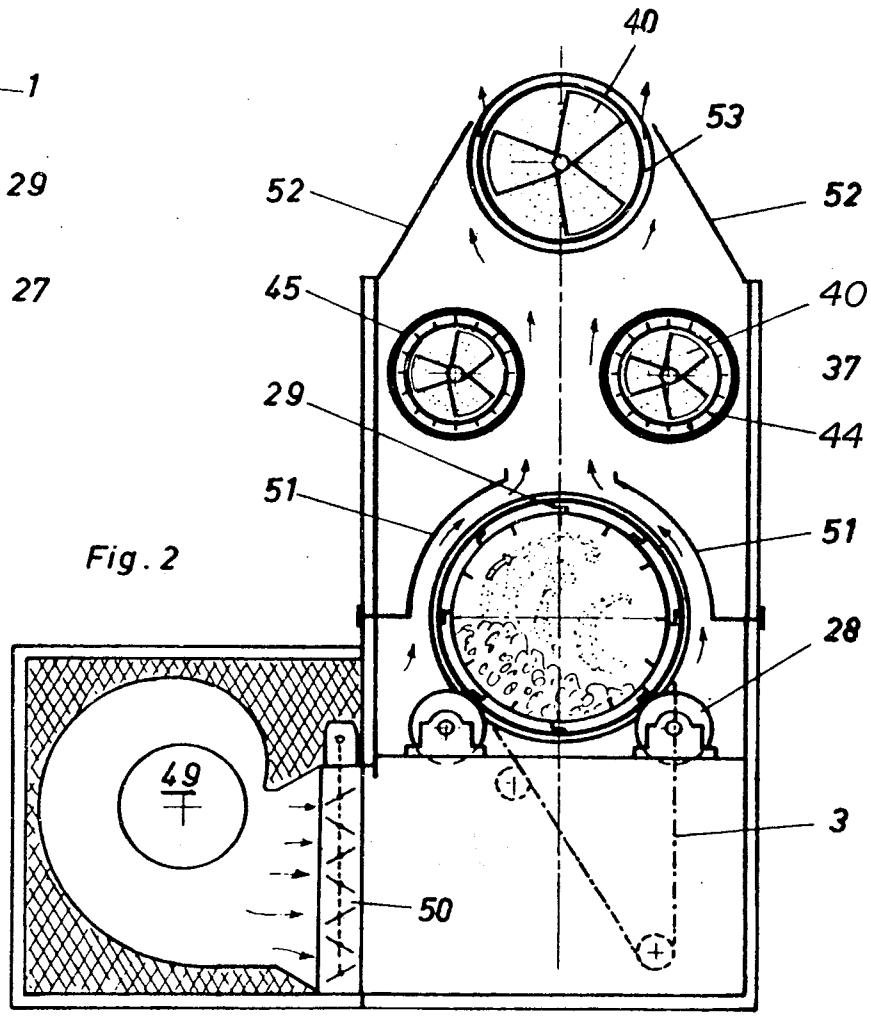
FIG. 2 is a cross-section taken on the line II—II of FIG. 1.
Figure 3:
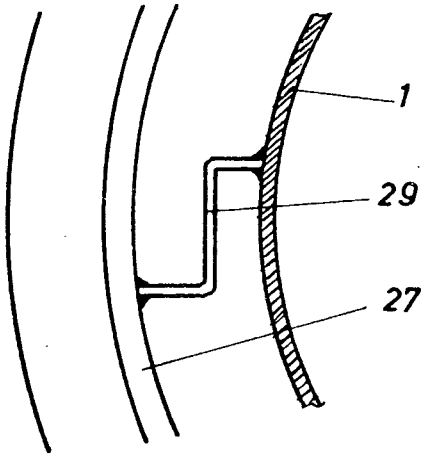
FIG. 3 is an enlarged drawing of one of the angle-shaped supports connecting the furnace to its circular support rotating guide.

Furnace 1 is rotatingly driven by two circular support guides 27 which support chambers 4 and 5 of the furnace respectively. The circular support guides each revolve on two rollers 28 (FIG. 2) which are mounted one on each side of the lower part of the revolving furnace. As can be seen in FIGS. 3 and 2, each circular support guide is connected to the outer wall of the rotating furnace by eight angle shaped supports 29. These supports have the function of absorbing possible thermal expansion of the circular support guides and of the revolving furnace in order to avoid any mechanical stress between the circular supporting guides and the furnace itself.

The cinder outlet opening is equipped with a thick concentrical ring 30 made of steel whith high heat resistance, which has the function of not letting through excessively large fragments of slag and incompletely burned waste, to further crush them, to prolong their combustion in chamber 1 and to act as a heat accumulator; this ring, by means of its high thermal inertia, compensates for occasional reductions in temperature in the vicinity of cinder outlet opening 20, so that an even and uninterrupted combustion of gases is achieved even when waste is incinerated at varying degrees of thermal values.

Figure 4:
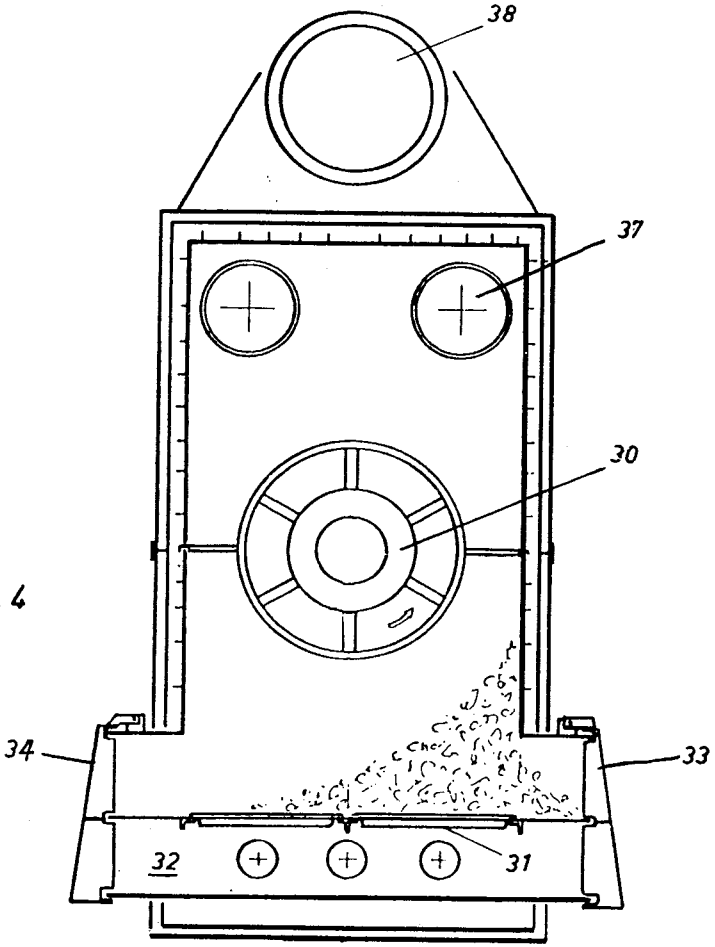
FIG. 4 is a cross-section taken on the line IV—IV of FIG. 1.

At the bottom of recombustion chamber 26 there is a grate 31 where the incineration of incompletely burned waste which has been expelled by the furnace is completed. Under grate 31 there is a collector 32 for the removal of slag and cinders. In order to remove slag and cinders form collector 32, as well as the non-incinerated materials remaining on grate 31 (glass, ceramics, pieces of metal etc.) chamber 26 has a single swing door 33 against which most of the slag and cinders and almost all unburned refuse coming from the revolving furnace pile up (see FIG. 4, to the right).

Directly opposite door 33 in chamber 26 there is an explosion door 34 whose function is to equalize the pressure in the unit in the event that an explosion should occur due to spray cans. The explosion door opens toward the outside. Directly opposite cinder outlet opening 20 of the revolving furnace there is a thick, heat-resistant steel plate 35 on the inner wall of chamber 26 which functions as a heat accumulator and compensates for occasional short temperature drops in chamber 26 in order to guarantee an even reburning of residual waste and of exhaust fumes not totally burned previously. Steel plate 35 can be replaced by a heat exchanger 36 (shown in dotted lines in FIG. 1) if the incinerating unit is also to be used as a heating source.

Above afterburning chamber 26, directly connected thereto, there are two parallel discharge tubes 37 which, in turn, discharge into a tube 38 which has a larger diameter and discharges into an exhaust stack 39. In tubes 37 and 38 there are vanes 40, the purpose of which is to obtain turbulence in the exiting exhaust fumes. In the exhaust stack 39 there is a suction fan 41 operated by motor M1 which draws the fumes from furnace 1 and from chamber 26 through tubes 37 and 38. In order to control pressure in the incinerating unit, at the end of duct 38 there is a butterfly valve 42 which is operated according to the pressure existing at the entry gate where the waste enters the furnace 1.

Each of the discharge tubes 37 has, lengthwise, heat dispersion fins 44 and is installed in turn in a tube 45 which has a larger diameter and through which air flows over fins 44. One end of an air duct 46 is directly connected to preheating chamber 11 at the point of entry of waste into chamber 1. At the other end, duct 46 is connected to a chamber 47, where slag and cinders are discharged. Chamber 47 surrounds the end section chamber 5 of revolving furnace 1. Chamber 47 receives from a pusher fan 48, driven by a motor M3 (FIG. 7), comburent air at a pressure of 20mm of water column above atmospheric pressure. Some of the air from chamber 47 reaches collector 32 directly beneath grate 31 and, flowing through this grate, acts as a comburent in chamber 26 to reburn waste not yet entirely incinerated; the major part of the air in chamber 47 flows as cooling air around end of chamber 5 of oven 1, a small portion of its flowing through a slit 43 (FIG. 5) into the recombustion chamber 26.

The larger portion of the cooling air flows through the two air ducts 46, reaches chamber 11 and openings 13 in hopper 10 and finally entry gate 12 of revolving furnace 1. The comburent air passing through the two ducts 46 is heated by exhaust gases flowing through the discharge tubes 37. The fins in ducts 37 create turbulence in the exhaust fumes, which enhances the transmission of heat to comburent air which is heated to a temperature of 300° to 400° C, and the exhaust gases are cooled proportionally. Since most of the air blown by pusher fan 48 is used as comburent, it is not necessary that such air be clean, for this purpose, air containing particles of dust and gas can also be utilised. The need for pure air is very limited. As is well known, steel with high heat resistance, up to a temperature of 600° C, holds up well against oxidation; therefore, below this temperature corrosion is minimal. Should this temperature level increase, the corrosion processes of steel increase exponentially. In the incinerator according to this invention; the revolving furnace is force cooled from the outside in such a manner that the temperature of the outer wall never goes above the level of 600° C. To this end, cooling chamber 2 receives cool air blown into it by a pusher fan 49 operated by a motor M4 (FIG. 4) which blows air through an air flow control system 50 activated by a motor M5 (FIG. 7), in this instance at the rate of 30,000 cubic meters/hour form the bottom to the top of the unit. In order to improve cooling, air flow channeling screens 51 (FIG. 2) are provided at both sides of the upper half of furnace 1, directing the air flow against the outer surface of revolving furnace 1. Cooling air flows out of the upper opening of air flow channeling screens 51 from chamber 2 through discharge tube 38. Two other flow channeling screens 52 (FIG. 2) force cooling air against cooling fins 52, further cooling the fumes before their being expelled through exhaust stack 39.

Vanes 40 in the discharge tube 38 determine a turbulence which always forces new portions of the exhaust fumes against the inner wall which is cooled. Consequently, exhaust fumes in duct 38 undergo a further cooling action.

After flowing through duct 38, cooling air flows out into the atmosphere mixed with the fumes and drawing them through the exhaust stack, thereby avoiding pollution.

The unit described contains a tubular revolving incinerator furnace which is the part most subjected to wear. In the event that breakdowns should occur, the furnace can be replaced. Since the revolving furnace is easily assembled, and its dimensions allow a certain degree of tolerance, such a furnace lends itself to industrial production. To the end of easily replacing the revolving furnace periodically at a low cost, the unit is conceived in two halves; an upper half and a lower half. It is easy to separate the upper half from the lower half and then disassemble the revolving furnace without excessive labor, to detach it from the lower half of the unit and replace it with another one.

Figure 5:
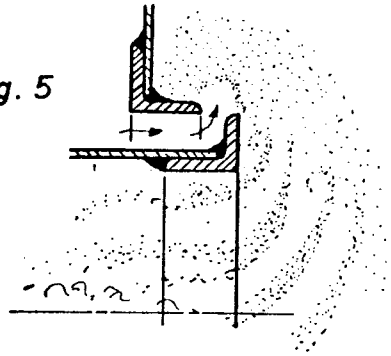
FIG. 5 is an enlarged cross-section of part of the rearward end of the rotary furnace.

FIG. 5 shows the system through which two halves of the unit are joined together in the vicinity of recombustion chamber 26; it is apparent from FIG. 5 that between the two halves there is a certain slack, so that under the influence of the operating heat of the unit, the joints can expand without causing mechanical stresses between the two halves. Furthermore, there is some tolerance between the two halves, a fact which makes it easier to build the unit and to assemble it.

When the unit is in operation, exhaust fumes from chamber 26 cannot leak out through the joint between the two halves and disperse themselves in the atmosphere since the pressure in the recombustion chamber is 4 mm of water column less than atmosphereic pressure.

Figure 6:
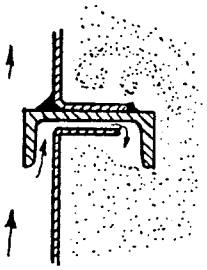
FIG. 6 is an enlarged cross-section of the support system between the upper and lower halves of the unit shown in FIG. 1, in the area of the stationary afterburner chamber.

While the unit operates (FIGS. 1 and 6), forces feeding device 9 receives a certain quantity of waste every time flaps 14 open up, equal to that contained in hopper 10 in the space between flaps 14 and 15. When flap 15 opens in hopper 10, the waste material falls downward and, through entry gate 12, reaches drying chamber 7 of revolving furnace 1, which rotates at a speed of approximately one revolution per minute. Opening flaps 14 and 15 operated by hydraulic cylinders 16 and 17, which compose the forced feeding device 9 (see FIG. 7), go on opening and closing alternately as long as the temperature of burned fumes in exhaust stack 39 does not go below 180° C nor above 360° C. Should the temperature fall below 180° C or increase above 360° C, actuators 16 and 17 stop, thereby preventing introduction of further waste.

Waste rapidly transported by screw conveyor 21 reaches dessication chamber 7 through opening 12 in order to leave room for the next load. In the meantime, waste transported by fins 22, which have a pitch of 15°, slowly reaches connecting tube 6 of the revolving furnace. Fins 22, while transporting the waste material, then crush it and mix it with preheated comburent air blown through entry gate 12. As long as the temperature of exhaust fumes in exhaust stack 39 does not go above 275° C nor below 250° C, waste transported through dessication chamber 7 is dried, preheated and ignited so that when it reaches connecting tube 6 of the revolving oven, it is already burning. Liquid waste is collected since the shape of chamber 7 does not allow it to leak out.

Liquid wastes in chamber 7 are vaporized in the lower end of the chamber. The resulting vapor is carried off by comburent air flowing through the furnace at a rate of about 7 meters per second, with the result that its combustible components are burned.

Waste material already in combustion which reaches connecting tube 6 due to the action of transporting blades 23, having an angulation of 45°, is rapidly discharged into chamber 8 of the revolving oven and from there is moved by transporting blades 24, having an inclination of 2° to 8°. The waste is thereby crushed further and mixed with comburent air. It follows that the waste, except for incombustible components and large fragments, is incinerated when reaching the end of incinerating chamber 8. The temperature in combustion chamber 8 reaches a level of 800° to 1000° C, which ensures complete sterility of slag, cinders and exhaust fumes. Exiting from combustion chamber 8, slag and cinders not entirely burned are rapidly discharged into reburning chamber 26 by short transporting blades 25 which have an angulation of 60 degrees. Larger pieces of as yet unburned waste are withheld in chamber 8 by the thick steel ring 30 disposed in cinder outlet opening 20 until such waste is sufficiently crushed and burned before being discharged into chamber 26.

Slag and waste parts which have not been completely incinerated fall through cinder outlet opening 20 of chamber 8 into chamber 26 and onto grate 31, which is in the lower part of chamber 26, and from here slag falls into collector 32.

Waste which has not been completely burned is held back by grate 31, where with the further assistance of comburent air blown by pusher fan 48, it burns completely. The speed of the exhaust fumes exiting from the revolving furnace upon entering reburning chamber 26, falls from approximately 7 meters/second to 1 meter/-second on account of the larger volume of chamber 26 in comparison with the volume of the rotating furnace. The result is that solid particles contained in the exhaust fumes fall into chamber 26, through grate 31 and into collector 32, so that exhaust fumes in the upper part of chamber 26 are practically free of solid components. Suction fan 41 installed in exhaust stack 39 draws the exhaust fumes through preheating discharge tube 37 and cooling duct 38 out of the upper chamber 26 and finally into exhaust stack 39 and into the atmosphere. Owing to the turbulence in ducts 37 and 38 caused by vanes 40, the fumes transfer a major part of their heat to the outer wall. Inside there ducts combustion air circulates in turbulence. Through cooling duct 38, exhaust fumes leave a further major portion of their heat to the cooling air moving from chamber 26.

Figure 7:
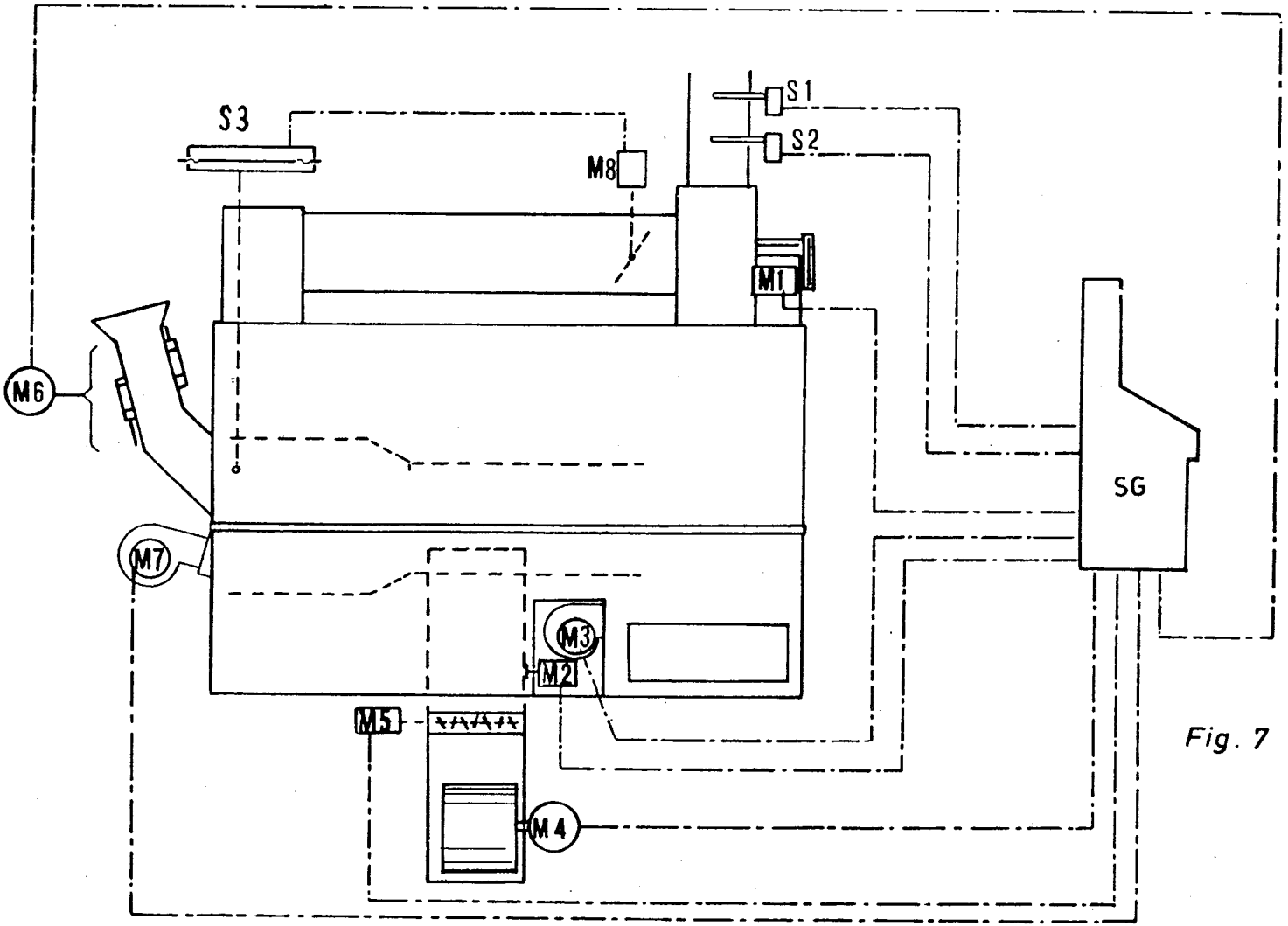
FIG. 7 is a schematic drawing of the automatic temperature and pressure control system for the interior of the rotary furnace shown in FIG. 1.
Figure 8:
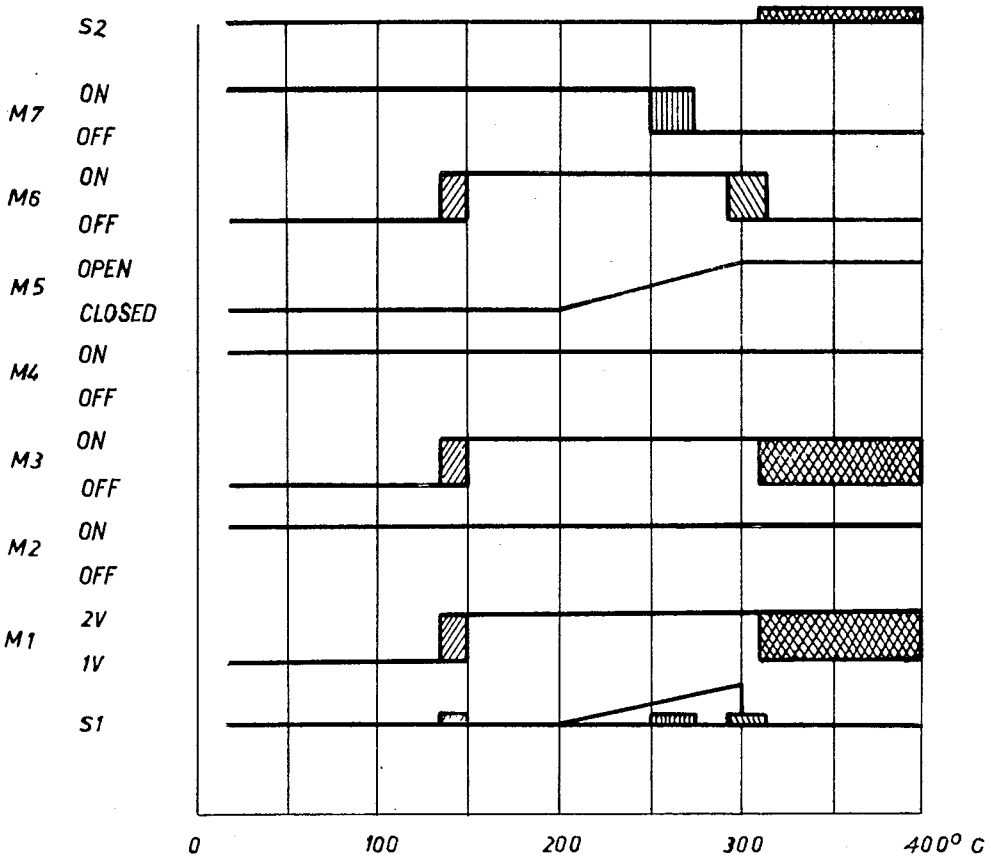
FIG. 8 is a diagram showing schematically the mode of operation of control system of FIG. 7 as a function of the temperature of the combustion gases.

FIG. 7 shows schematically the system for automatically controlling the temperature and pressure inside the unit depicted in FIGS. 1 to 6, and FIG. 8 shows the mode of operation of this system as a function of the temperature of combustion gases in the stack of the unit. The regulator system (FIG. 7) comprises a first thermocouple S1 and a second thermocouple S2 which sense the temperature of combustion gases flowing through the stack.

In order to regulate the pressure inside the unit, the system is equipped with a manometer S3 measuring the pressure of comburent air at the inlet opening 12 of revolving furnace 1. The control system is furthermore provided with a control apparatus SG operating motors M1 to M7 of the unit.

For starting up the waste incinerating unit, control apparatus SG is switched on, which in turn operates motor M1 (twospeed motor) operating suction fan 41 in stack 39; this motor rotates at a speed lower than 950 RPM. Control apparatus SG also starts motor M2 which drives furnace 1, motor M4 of cooling air pressure fan 49, and motor M7 conveying the fuel to burner 18, and simultaneously causes the flame of burner 18 to ignite. The servomotor of valve opening control system 50, for controlling the inflow of fresh air to the revolving furnace, is not turned on, so that the furnace does not yet receive cooling air. Motor M6 of the loading hopper and motor M3 are still switched off as well, so that no refuse can yet be let into the unit, nor does pressure fan 48 yet blow comburent air. The unit is heated up by burner 18 flame, and the temperature of the air sucked by suction fan 41 and ejected through stack 39 increases. When the air ejected from stack 39 reaches a temperature of 150° C, thermocouple S1 causes control device SG to accelerate motor M1 of suction fan 41 to its highest speed of 1400 RPM. Motor M3 of pressure fan 48 is also operated and starts to blow comburent air, as is motor M6 of loading hopper 10, which periodically and alternately opens and closes flaps 14 and 15 so that the unit can receive refuse. As the waste incineration in revolving furnace 1 goes on, a slow increase in temperature occurs. As soon as a temperature of 200° C of the exhaust gases in stack 39 is reached, thermocouple S1 acts on control apparatus SG, and starting motor MS starts to open fans 50 so that revolving furnace 1 starts to be air cooled. Upon further increase in temperature, fans 50 operated by motor M5 are opened more and more so that the temperature in the revolving furnace always remains about 600° C. When the temperature of burnt gases in stack 39 reaches about 275° C, thermocouple S1 acts on control apparatus SG, which stops motor M6 of the burner, and consequently the flame goes out. If the temperature of the burnt gases in stack 39 falls to 250° C owing to the combustion of low heat-efficiency waste, the motor of burner M6 is activated again, and the flame ignites. If the temperature of burnt gases in stack 39 increases again in spite of the fact that the burner has been deactivated, and reaches 320° C, thermocouple S1 acts on control apparatus SG, which stops motor M6 in order to prevent further refuse from entering. If, in spite of this, the temperature of the exhaus gases in stack 39 increases again and reaches 400° C, then thermocouple S2 acts on control apparatus SG which stops motor M3 so that no more comburent air is blown into the revolving furnace, the speed of motor M1 is reduced to 950 RPM, and the draft is reduced throughout the unit. In this way, the burning waste does not receive enough oxygen, and this greatly slows the combustion, decreasing the furnace temperature in proportion. If the temperature drops below 310° C, thermosensor S2 via control apparatus SG, causes motor M3 to run again, the furnace receives comburent air again, and motor M1 runs at its highest speed of 1400 RPM in order to increase the draft in the unit. Should the temperature of the burnt gases drop below 130° C, for instance at the end of a cycle of the unit, thermocouple S1, acting via control apparatus SG, stops motors M3 and M6 so that comburent air stops flowing, and no more refuse is brought into the unit.

Control unit SG can be regulated in such a way as to have the revolving furnace loaded with refuse at fixed and regular intervals, or it can be filled with refuse at intervals of time whose length is proportional to the temperature of the exhaust gases i.e. at shorter intervals at low temperatures, and at longer intervals when the temperature of the gases increases. In such a way, a more even temperature in the unit can be obtained.

During normal running of the waste incinerating unit, butterfly valve 42 in cooling duct 38 can be regulated by means of manometer S3 in such a way that the air pressure in preheating chamber 11 of revolving furnace 1 is almost equal to atmospheric pressure, and at entry gate 12 of revolving furnace 1 is about 2 mm of water column lower than atmospheric pressure. It follows that fresh air is not brought into the revolving oven from the atmosphere, so that the preheated blown air does not undergo cooling in the revolving furnace.

The waste incinerating unit described in this invention can be designed as a vehicle, e.g. mounted on a truck, so as to be used directly on the spot, for instance, in the event of disasters with enormous quantities of liquid and/or solid waste. This design is possible because the revolving furnace needs no brickwork, is therefore light and of a reasonable diameter. Furthermore, the refuse conveyal through the revolving furnace, owing to the length and pitch of the conveying blades, can be arranged in such a way that dessication, preheating, combustion and incineration can take place in a short run.

The revolving furnace can be rather short, so that the waste incinerating unit can be mounted on a standard truck. Such a mobile unit can be used near residential areas since the unit exhausts only sterile and virtually solid-free gases. As previously described, it is inpossible for non-sterile or incompletely combusted gases to leak from the unit as the pressure of exhaust gases in the unit is always somewhat lower than atmospheric pressure.

The waste incinerating unit described in this invention consists of a lower section and a upper section which can be easily detached from one another, and the revolving furnace can be replacedright on the spot where it is used, even using unskilled labor. For this purpose, the upper section of the unit is detached from the lower one, making the revolving furnace, located in the lower section, easily accessible; and once the transmission chain is detached, the revolving furnace can be removed immediately and a new one mounted in its place in the lower section of the unit. Since the revolving furnace of the waste incinerating unit herein described does not need any brickwork and consequently has low thermal inertia, when the unit is stopped, it becomes cool in a short time, so that after the replacement of the revolving furnace the unit can start running in an equally short time; the replacement of the revolving furnace involves no long stoppages.

The useful life of the revolving furnace, according to the present invention is comparatively high as during operation the inner wall is heated to a temperature of about 600° C; at such a temperature, deterioration of the revolving furnace due to thermal factors cannot take place, and the furnace is not housed in masonry which is likely to be damaged by hard objects or spray cans.

The revolving furnace for the waste incinerating unit is easily manufactured and can be mass-produced: as the replacement of the revolving furnace is rapidly and easily carried out by non-specialized labor, the costs of replacement of the revolving furnace according to this invention are relatively low.

What is claimed is:

1. An incinerator comprising a rotary furnace of highly heat resistant steal, having a horizontal axis of rotation and comprising a drying chamber and an incinerating chamber; drive means for rotating said furnace; charging means for feeding refuse to said drying chamber; a burner projecting into said drying chamber; afterburner means for recombusting any incompletely burned refuse leaving said incinerating chamber and for ridding combustion gases of solids; means for supplying preheated comburent air to said furnace; and means for cooling and exhausting said combustion gases; wherein said furnace further comprises:

first and second cylindrical sections connected by a hollow, frustoconical connecting piece which is shorter than both said first and second sections, said first section containing said drying chamber and said second section containing said incinerating chamber, said first section being shorter in length and larger in diameter than said second section so that said drying chamber is shorter in length and has a larger inside diameter than said incinerating chamber and has a laterally closed-off portion;

a refuse entry gate disposed at the end of said first section remote from said section and having an inside diameter smaller than that of said first section, said laterally closed-off portion of said drying chamber being situated below the level of said entry gate and said incinerating chamber for preventing liquid refuse from flowing out of said drying chamber;

a slag and cinder outlet opening disposed at the end of said second section remote from said first section;

a screw conveyor disposed on that portion of the inside wall of said drying chamber nearest said entry gate;

a first series of conveyor blades disposed on the remainder of said inside wall of said drying chamber;

a second series of conveyor blades disposed on the inside wall of said connecting piece;

a third series of conveyor blades disposed on the inside wall of said incinerating chamber from the junction thereof with said connecting piece to the vicinity of said outlet opening; and a fourth series of conveyor blades disposed immediately adjacent to said outlet opening, said blades of said first series having an angle of pitch, relative to said axis of rotation, which is greater than that of said third series but less than that of said second and fourth series, and said blades of said second series having an angle of pitch, relative to said axis of rotation, which is less than that of said fourth series, said refuse thereby being rapidly carried away from the region of said entry gate by said screw conveyor upon rotation of said furnace, then moved relatively slowly through said drying chamber by said first series of blades for the purpose of drying and pre-heating, thereafter transported relatively quickly through said connecting piece into said incinerating chamber by said second series of blades, and moved on by said third series of blades within said incinerating chamber more slowly than in said drying chamber for being incinerated until the resultant ash reaches said fourth series of blades and is rapidly removed thereby from said rotary furnace through said outlet opening; and said incinerator further comprising for cooling the outer wall of said furnace:

a stationary cooling chamber in which said furnace is mounted for rotation, at least one pusher fan for supplying cooling air to said cooling chamber, adjustable air-flow control means disposed between said at least one pusher fan and said cooling chamber for adjusting the rate of flow of said cooling air through said cooling chamber, and air-flow chanelling screens disposed on each side of the upper half of said rotary furnace and spaced therefrom for directing said cooling air around said upper half of said furnace, said screens defining an elongated opening above said furnace for the excape of said cooling air from said cooling chamber.

2. The incinerator of claim 1, wherein said charging means comprise a refuse hopper, two closure members spaced from one another operatable within said hopper for closing said hopper and control means for alternately shutting and opening said closure members, a quantity of said refuse determined by the size of the space within said hopper between said closure members being conveyable to said charging means when the one said closure member is open and the other said closure member is shut; said quantity of refuse being conveyed to said entry gate upon shutting of said one closure member and opening of said other closure member.

3. The incinerator of claim 2, further comprising at least one annular chamber surrounding the end of said furnace at which said entry gate is disposed for closing off said end toward the outside, said hopper comprising openings whereby said at least one annular chamber communicates with said entry gate, said hopper and said burner extending through said annular chamber, and said comburent air being supplied to said furnace via said openings.

4. The incinerator of claim 3, wherein said afterburner means comprise a stationary afterburning chamber into which said outlet opening opens, a grate disposed near the bottom of said afterburning chamber for afterburning large pieces of said refuse, and a collector formed beneath said grate for receiving ashes, said incinerator further comprising a further pusher fan disposed above said collector for supplying afterburning air, said afterburning chamber having a substantially greater corss-sectional area than said incinerating chamber of said rotary furnace, whereby the rate of flow of said combustion gases entering said afterburning chamber from said furnace is greatly reduced and solid particles carried along by said combustion gases sink to the bottom of said afterburning chamber.

5. The incinerator of claim 4, wherein said means for cooling and exhausting said combustion gases comprise at least a first discharge tube leading out of the top of said afterburning chamber, at least a second discharge tube connected to said first discharge tube, an exhaust stack into which said second discharge tube opens, a suction fan disposed within said exhaust stack for drawing off said combustion gases from said afterburning chamber, and vanes disposed within each said discharge tube, said first discharge tube having longitudinally extending cooling fins disposed on the outside thereof, said second discharge tube having annular cooling fins disposed on the outside thereof, and said vanes being arranged to produce a turbulent flow of said combustion gases leaving said afterburning chamber, whereby successive portions of said gases transfer their heat in turn to the walls of said discharge tubes.

6. The incinerator of claim 5, wherein said means for supplying said preheated comburent air comprise said at least one annular chamber surrounding the end of said furnace at which said entry gate is disposed, a further annular chamber surrounding the end of said furnace at which said outlet opening is disposed and forming an annular slit around said outlet end of said furnace, and a preheating tube communicating with said further annular chamber and surrounding said first discharge to form an air duct through which said cooling ribs of said first discharge tube extend, said further pusher fan also communicating with said further annular chamber and supplying comburent air thereto, the lesser portion of said comburent air flowing through said annular slit into said afterburning chamber as additional afterburning air and thereby cooling said outlet end of said furnace, and the greater part of said comburent air flowing through said air duct to said at least one annular chamber as comburent air for said furnace and thereby being heated by said combustion gases in said first discharge tube, whereby said combustion gases are cooled accordingly.

7. The incinerator of claim 1, wherein said blades of said first series have an angle of pitch of approximately 15°, said blades of said second series have an angle of pitch of approximately 45°, said blades of said third series have an angle of pitch of from 2° to 3°, and said blades of said fourth series have an angle of pitch of approximately 60° with respect to said axis of rotation of said furnace.

8. The incinerator of claim 6, wherein said rotary furnace further comprises a thick steel ring disposed in said outlet opening concentrically with said axis of rotation of said furnace, the outside diameter of said steel ring being less than the inside diameter of said outlet opening, said steel ring serving as a means for retaining large, unburned pieces of said refuse in said incinerating chamber and as a heat accumulator for compensating shortterm temperature fluctuations in the region of said outlet opening.

9. The incinerator of claim 8, further comprising a thick steel plate forming at least part of the wall of said after burning chamber opposite said outlet opening, said steel plate serving as a heat accumulator for compensating short-term temperature fluctuations in said afterbunring chamber.

10. The incinerator of claim 9, further comprising a heat exchanger capable of being substituted for said steel plate for utilizing waste heat in said afterburning chamber for heating a liquid or gaseous heat carrier.

11. The incinerator of claim 10, further comprising a plurality of rollers disposed beneath said furnace on each side thereof, a plurality of circular support rings each running on a pair of said rollers and supporting said furnace, and a plurality of double-angled supports connected at one end to each said support ring and at the other end to the other wall of said furnace for keeping each said support ring spaced from said outer wall, whereby said support rings and said furnace are enabled to expand and contract independently of one another under the influence of heat without the occurrence of mechanical stresses between said support rings and said furnace.

12. The incinerator of claim 11, further comprising three drive motors for driving said charging means, said further pusher fan, and said suction fan, respectively, a burner motor for feeding said burner with fuel at least one servomotor for adjusting said adjustable air-flow control means, and a control system for regulating the supply of refuse, comburent air, and cooling air to said furnace as a function of the combustion temperature in said exhaust stack, said control system in turn comprising a control apparatus and first and second thermocouples connected to said control apparatus and disposed in said exhaust stack after said suction fan in the direction of flow of said combustion gases for sensing the temperature of said combustion gases flowing out through said exhaust stack, said first thermocouple keping said charging means drive motor switched on via said control apparatus for charging said furnace with refuse at predetermined intervals when the combustion temperature is comprised within a first temperature range, causing said charging means drive motor to be switched off via said control apparatus when the combustion temperature exceeds the maximum temperature of said first temperature range, causing said charging means drive motor and said further pusher fan drive motor to be switched off via said control apparatus and said suction fan drive motor to be switched from a higher to a lower speed of rotation via said control apparatus when the combustion temperature drops below the minimum temperature of said first temperature range, causing said burner motor to be switched off via said control apparatus when the combustion gas temperature exceeds a first temperature in the upper part of said first temperature range, and to be switched on via said control apparatus when the combustion gas temperature drops below a second temperature lower than said first temperature within said first temperature range, and adjusting said air-flow control means proportionately to the combustion gas temperature via said control apparatus and said at least one servomotor when said combustion gas temperature is comprised within a second temperature range situated within said first temperature range, whereby said furnace recieves a volume of cooling air proportionate to the combustion gas temperature in said second temperature range, said second thermocouple causing said further pusher fan drive motor to be switched off and said suction fan drive motor to be switched from said higher to said lower speed of rotation via said control apparatus when the combustion gas temperature exceeds a temperature above said maximum temperature of said first temperature range, and causing said further pusher fan drive motor to be switched on and said suction fan motor to be switched from said lower to said higher speed of rotation via said control apparatus when the combustion gas temperature drops below said maximum temperature of said first temperature range.

13. The incinerator of claim 12, wherein said control apparatus is designed to actuate said charging means drive motor at equal intervals for supplying said refuse to said furnace as long as the combustion gas temperature is comprised within said first temperature range.

14. The incinerator of claim 12, wherein said control apparatus is designed to actuate said charging means drive motor at intervals proportionate to the combustion gas temperature is comprised within said first temperature range.

15. The incinerator of claim 12, further comprising a pressurecontrol system for regulating the pressure in said entry gate of said furnace to a value somewhat below atmospheric pressure, said pressure-control system in turn comprising a manometer for measuring the pressure in said entry gate, a butterfly valve disposed between said second discharge tube and said exhaust stack, and a further servomotor actuated by said manometer as a function of the pressure in said entry gate for adjusting said butterfly valve.

16. The incinerator of claim 15, consisting of a lower half comprising said rotary furnace and said grate of said afterburning chamber, and an upper half which can be lifted off said lower half, whereby said furnace and said grate are freely accessible for purposes of replacement.

* * * * *

UNITED STATES PATENT AND TRADEMARK OFFICE

CERTIFICATE OF CORRECTION

PATENT NO. : 4,060,042

DATED : November 29, 1977

INVENTOR(S) : Enzo Baraldi and Giuliano Longhi

It is certified that error appears in the above-identified patent and that said Letters Patent are hereby corrected as shown below:

Column 1, line 32: "dessication" should be --the dessication--;

line 37: "tuck" should be --truck--; and line 51: "vertually" should be --virtually--.

Column 3, line 27: "hopped" should be --hopper--;

line 32: "of" should be --or--; and line 36: "forced-feeling" should be --forced feeding- Column 4, line 46: "form" should be --from--.

Column 5, line 28: "its" should be --it--;

line 56: "form" should be --from--; and line 64: "fins 52" should be --fins 53--.

Column 6, line 34: "atmosphereic" should be --atmospheric--;and line 36: "forces" should be --forced--.

Column 7, line 47: "there" should be --these--.

UNITED STATES PATENT AND TRADEMARK OFFICE

CERTIFICATE OF CORRECTION - page 2 of 2

PATENT NO. : 4,060,042

DATED : November 29, 1977

INVENTOR(S) : Enzo Baraldi and Giuliano Longhi

It is certified that error appears in the above-identified patent and that said Letters Patent are hereby corrected as shown below:

Column 8, line 44; "exhaus" should be --exhaust--.

Column 9, line 36; "replacedright" should be --replaced right--; and line 66; "steal" should be --steel--.

Column 11, line 8; "excape" should be --escape--.

Column 12, line 50; "other wall" should be --outer wall--.

Column 13, line 3; "keping" should be --keeping--.

Column 14, line 21; "pressurecontrol" should be --pressure control--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*